United States Patent [19]

Barclay

[11] Patent Number: 4,976,178

[45] **Date of Patent: * Dec. 11, 1990**

[54] ANNULAR SCRAP SEGMENTS IN TIRE REDUCTION

[76] Inventor: Randel L. Barclay, 5616 Carpenter Rd., Stockton, Calif. 95205

[ * ] Notice: The portion of the term of this patent subsequent to Jul. 28, 2004 has been disclaimed.

[21] Appl. No.: 225,908

[22] Filed: Jul. 28, 1988

[51] Int. Cl.[5] ..... B02C 18/06; B26D 1/24

[52] U.S. Cl. ..... 83/19; 83/54; 83/176; 83/345; 83/404.2; 83/951

[58] Field of Search ..... 83/19, 176, 404.2, 435.2, 83/508.3, 923, 925, 54, 345, 951; 241/DIG. 31

[56] References Cited

U.S. PATENT DOCUMENTS 3,460,419 8/1969 Branick ..... 83/422
4,682,522 7/1987 Barclay ..... 83/19

FOREIGN PATENT DOCUMENTS 937226 6/1982 U.S.S.R. .

*Primary Examiner*—Hien H. Phan
*Attorney, Agent, or Firm*—Thomas Schneck

[57] ABSTRACT

An apparatus for dividing scrap tires having a compression transport in a rotary shear station. The compression transport centers the tire and provides forces onto the treaded periphery to buckle the scrap tire. The compression transport then feeds the tire to the rotary shear station in a straight-line manner. The rotary shear station has overlapping and counter-rotating circular shears that make at least one cut along the length of the collapsed tire to produce annular tire segments. The movement of the collapsed tire relative to the rotary shear station remains a linear movement during the shearing process. Preferably, the rotary shearing station includes a pair of coaxial circular shears that are spaced apart by a third shear supported on a shaft parallel to a shaft supporting the spaced pair of shears. In this manner, the scrap tire is reduced to three segments as a pair of shearing cuts are made parallel to the flattened tread of the scrap tire. Adjacent shears are spaced apart from each other by a distance not exceeding 0.003 inches.

15 Claims, 8 Drawing Sheets

ANNULAR SCRAP SEGMENTS IN TIRE REDUCTION

DESCRIPTION

1. Technical Field

The present invention relates to apparatus and a method for reducing scrap tires into segments suitable for further reduction in other equipment.

2. Background Art

To date the problems of disposing, burning and transporting discarded tires are many and varied. In recycling tires for fuel, the most utilized method is cutting scrap tires into two inch chips. This has generally proved not to be cost effective since the cost of collecting, transporting and cutting the tires is more than the return in value as fuel.

The dimensions of a tire make it difficult to stack tires in a low volume consuming manner. In transporting tires to a recycling plant, motor trucks at times carry only one-half a full load by weight. Since a motor truck not loaded to its full weight potential costs very nearly as much to operate as one that is, the cost effectiveness of recycling scrap tires may be increased by increasing the weight load carried by the motor truck.

U.S. Pat. No. 3,460,419 to Branick teaches a tire cutting apparatus for decreasing the volume occupied by scrap tires when packed or transported, such as may be hauled in a truck of a given capacity. Branick teaches that a scrap tire is to be positioned on a wheel having a pair of spaced grooves about the circumference of the wheel. A pair of rotary knives are then brought into contact with the tire. The knives are spaced apart to fit into the grooves of the wheel. The tire is then rotated so that the knives cut away the crown portion from the sidewalls of the scrap tire. While the Branick apparatus is adequate in a low-volume application, the apparatus is labor intensive since an operator must place each tire over the cylindrical wheel before cutting of the scrap tire. Moreover, with the increased use of steel belting in tire manufacturing, use of knives to cut into a scrap tire requires frequent maintenance and replacement of the circular knives.

An object of the present invention is to provide a more efficient method and apparatus for dividing scrap tires. A further object is to provide such an apparatus which has a lower operating cost and a higher degree of portability than found in the prior art.

DISCLOSURE OF THE INVENTION

The above objects have been met by a tire shearing machine which divides a scrap tire during linear movement of the tire relative to a shearing station. That is, the scrap tire need not be positioned on a cylindrical drum or other apparatus which can then provide rotational movement of the tire. Nevertheless, the tire shearing machine provides one or more divisions which render tires more easily transported, or burned, or more readily reduced to even smaller pieces for burning.

A compression transport feeds the uncut scrap tires into a rotary shear station. The compression transport centers the tire and at the same time provides forces that compress the scrap tire in relation to the treaded periphery of the tire. The compression transport may be a plurality of horizontal and vertical rollers that form a funnel-like configuration leading to the rotary shear station. Alternatively, the compression transport may have a plurality of spaced-apart paddle assemblies which feed the rotary shear station.

The compression transport collapses the scrap tire, thereby bringing opposed tread regions of the tire into close proximity. The advancement of the collapsed tire relative to the rotary shear station is a linear advancement. The rotary shear station has overlapping and counter-rotating circular shears and is positioned to make at least one separation along the length of the linearly advancing tire, thereby producing annular tire segments. Preferably, the rotary shear station includes two coaxial circular shears that are spaced apart by a middle circular shear that counter-rotationally overlaps the two coaxial shears. In this manner, the rotary shear station produces three annular tire segments, with the sidewalls remaining intact in a center portion, or crown portion, of the tire that is the width of the middle circular shear comprising the third annular segment. This division of the scrap tire facilitates removal of the tire's bead wires and permits removal of dirt, water and other non-rubber materials from the tire casing prior to introduction to a combustion chamber.

The present invention provides a new method of shearing tires in which a tire is first compressed by circumferential pressure about the tire periphery, bringing opposed tread regions into proximity. The flattened tire is sheared along the circumferential periphery, i.e. in a plane parallel to the plane of the flattened tread.

BEST MODE FOR CARRYING OUT THE INVENTION

Figure 1:
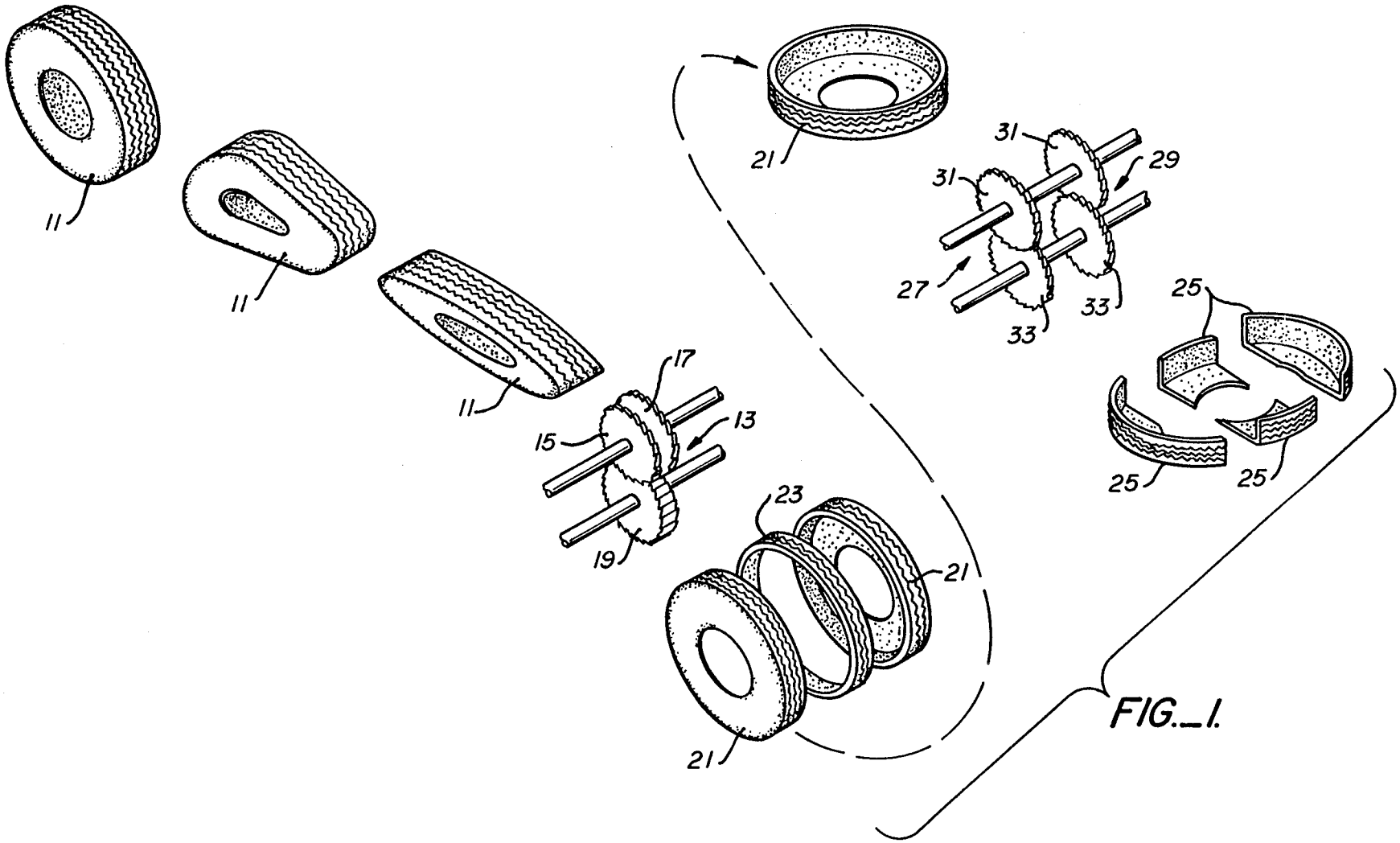
FIG. 1 is a plan view of the tire shearing operation carried out by apparatus of the present invention.

With reference to FIG. 1, a tire 11 is fed into a first rotary shear 13. The tire 11 is compressed before reaching the rotary shear. The movement toward and then through the rotary shear is a linear movement. The first rotary shear 13 has a pair of coaxially mounted circular shears 15, 17 which are rotated in a direction opposite of a middle shear 19. The three shears may be either closely spaced or contacting to achieve shearing action. The first rotary shear 13 cuts the tire 11 into three annular segments--two side wall segments 21 and a crown segment 23.

Each annular tire segment is then sheared into four arcuate parts 25 by a second 27 and a third 29 rotary, interleaving shear. The second and third rotary shears 27 and 29 each have a pair of counter-rotating shears 31 and 33 that cut an annular tire segment 21. The construction of interleaving rotary shears in known. See U.S. Pat. No. 4,607,800 to R. L. Barclay, for example, incorporated by reference herein.

Figure 2:
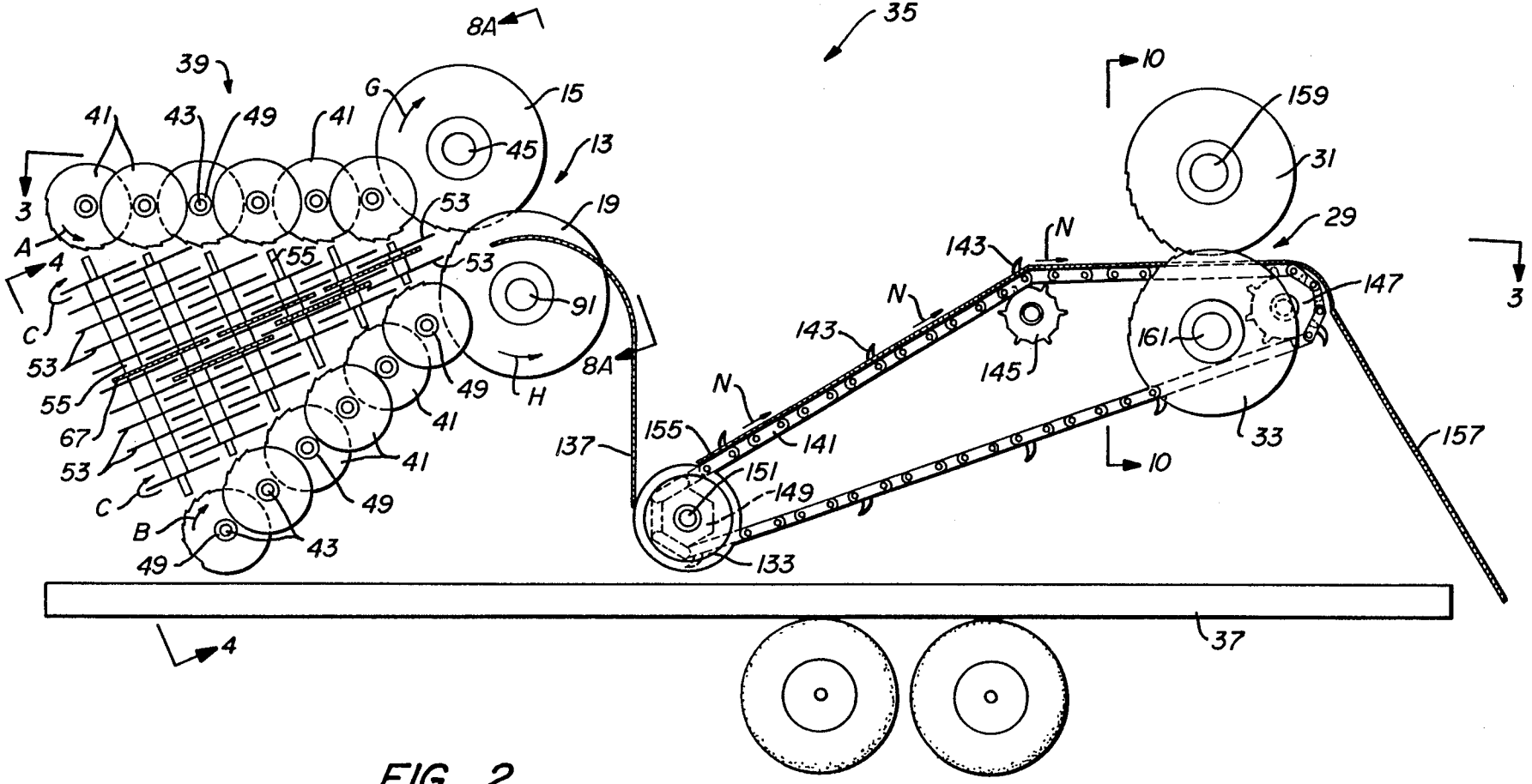
FIG. 2 is a side plan view of a mobile shearing apparatus in accord with the present invention.
Figure 3:
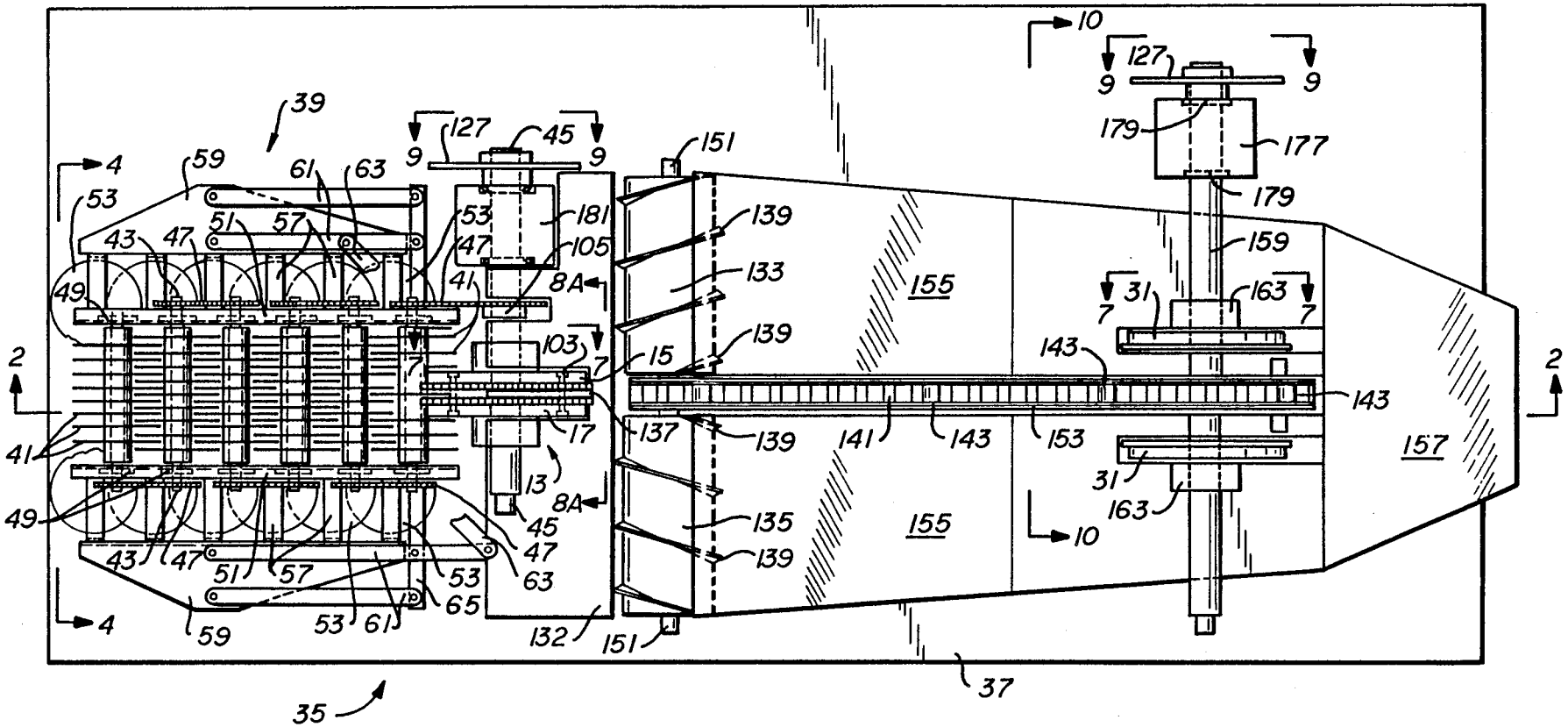
FIG. 3 is a top view of the shearing apparatus taken along lines 3—3 of FIG. 2.

Now referring to FIGS. 2 and 3, the shearing machine 35 is seen mounted on a trailer 37. A scrap tire is brought to the first rotary shear 13 by a compression conveyor 39. Two rows of compression rollers 41 are arranged to form a V-shaped compression assembly. FIG. 3 illustrates the rows of rollers as consisting of seven, eight or nine compression rollers 41 in various rows, but the number of rollers in a row is not critical.

A scrap tire is inserted into the compression conveyor 39 in an upright position, in relation to the side view of FIG. 2. The compression rollers 41 are sawtooth and the rows of rollers are each fixed to a rotating shaft 43 to carry the tire in the direction of the first rotary shear 13. The directions of compression roller rotation are indicated by Arrows A and B.

The compression roller shafts 43 are powered by rotation of the shear drive shaft 45 through a number of chains or belts 47 and are supported on bearings 49 within frames 51. The manner of providing rotational power to the shear drive shaft 45 is described below.

The V-shaped compression assembly grasps any common size tire to advance the tire in an upright position toward the first rotary shear 13. As the tire moves into the assembly, the configuration of the assembly will provide compression force to the tread area on opposing sides of the tire's circumferential periphery. Preferably, the tire will be compressed to a size of approximately 6–8 inches before the first rotary shear 13 cuts the tire through the tread area.

The compression conveyor 39 also includes a gripper assembly which grips the side walls of a tire. The gripper assembly centers a tire progressing through the compression conveyor. The assembly is comprised of a plurality of gripper rollers 53 on gripper roller shafts 55.

The gripper roller shafts 55 are arranged in a pair of parallel lines, as shown in FIG. 3. Each gripper roller shaft is attached to a brace arm 57 and the brace arms are fixed to frames 59. The frames 59 are spring biased, not shown, so that the frames are urged toward each other. For example, the frames may be biased into a closed position by a helical spring connecting the frames. Radius arms 61 and cross-braces 63 and 65 ensure that frames 59 work to center tires. The radius arms 61 are pivotably mounted to the frames 59 and cross-braces 63 and 65. The parallel rows of gripper roller shafts 55 are typically in a closed position with the gripper rollers 53 being spaced apart by approximately three inches; but for the purpose of clarity, FIG. 3 shows cross-brace 63 in a split condition and the frames 59 and gripper rollers 53 in an open position.

Referring particularly to FIG. 2, the gripper roller shafts 55 closest to the first rotary shear 13 provide less support for gripper rollers 53 than do shafts further from the first rotary shear. This arrangement is to accommodate the V-shape configuration of the compression roller assembly. Thus, the conveyor assembly 39 acts as a funnel for the first rotary shear 13. The gripper roller shafts 55 are interconnected by belts or chains 67 to synchronize shaft rotation. Arrows C indicate the direction of rotation for the shafts.

Figure 4:
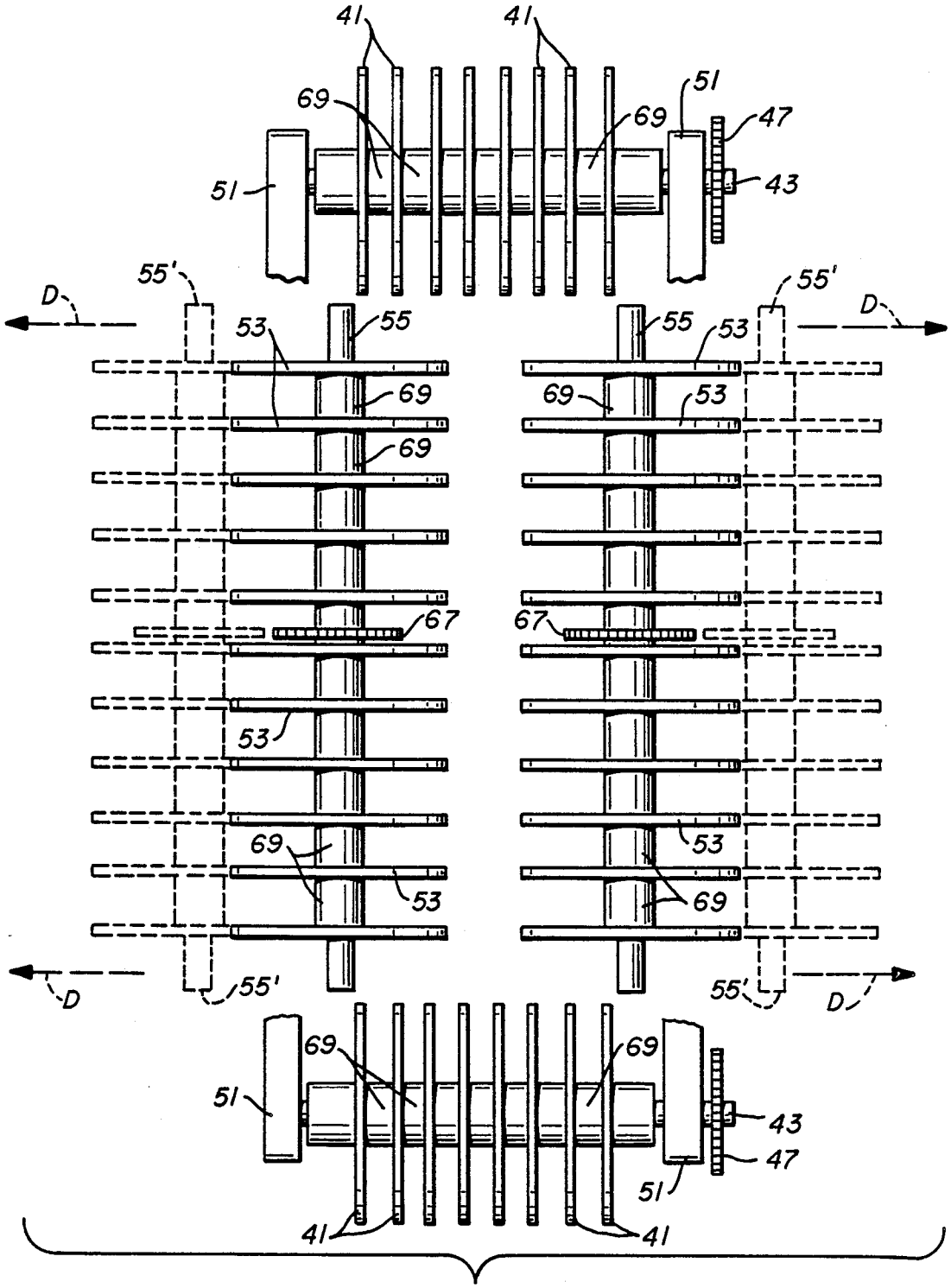
FIG. 4 is a front view of a compression conveyor of the present invention taken along lines 4—4 in FIGS. 2 and 3.

Referring now to FIG. 4, a scrap tire is inserted into a compression conveyor in an upright position. In this manner, the treaded area of the tire will contact the compression rollers 41 and the side walls of the tire will contact the gripper rollers 53. FIG. 4 shows only those compression rollers and gripper rollers furthest from the first rotary shear. Each roller 41 and 53 is spaced apart from an adjacent roller by a spacer hub 69. The spacer hubs 69 are preferably two inches in length.

Because the gripper rollers 53 of opposed shafts 55 are normally only three inches apart, insertion of a scrap tire into the compression conveyor will urge the shafts 55 in the direction of Arrows D to an open position 55'. The range of movement is dictated by the width of the tire. The gripper rollers will center a tire in the compression conveyor 39. Centering is important since a tire exiting the conveyor enters the first rotary shear with a bead wire on each side of the shear cut. The gripper rollers 53 are also effective in moving a tire too small to contact the upper and lower sawtooth rollers 41 of the V-shaped compression assembly.

Figure 5:
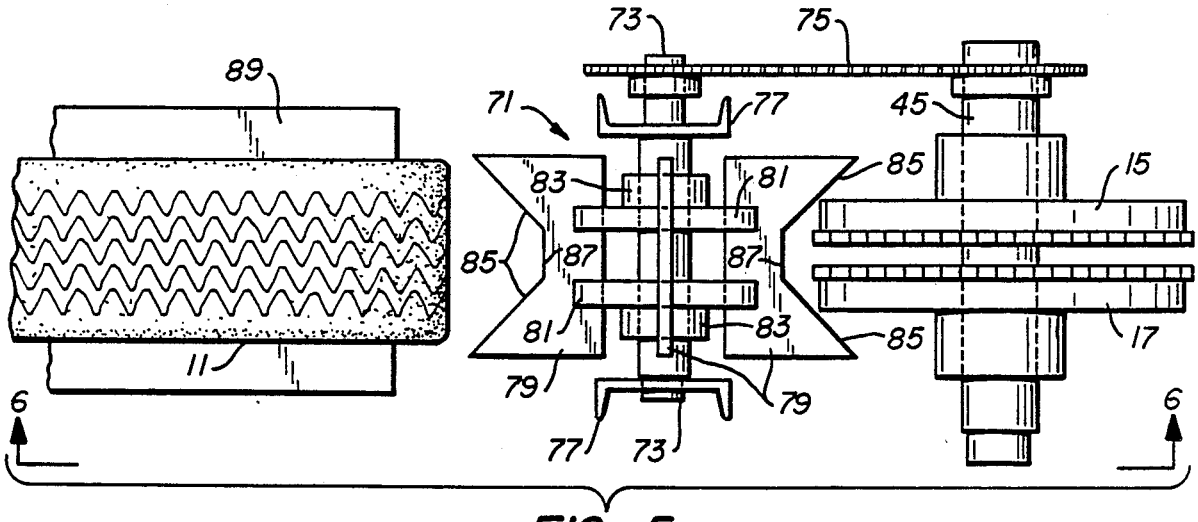
FIG. 5 is a top view of an alternative embodiment of the compression conveyor of FIG. 4.
Figure 6:
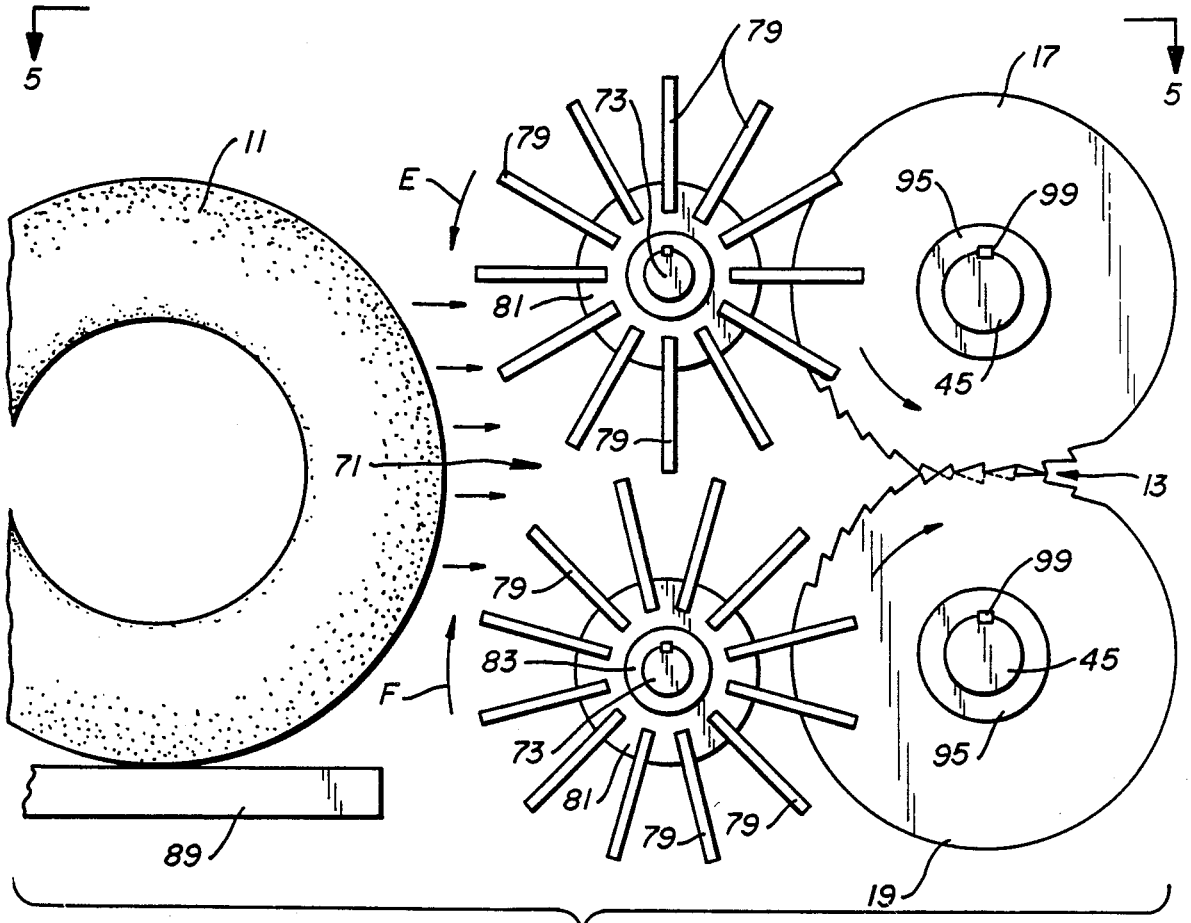
FIG. 6 is a side view of the compression conveyor of FIG. 5 taken along lines 6—6.

FIGS. 5 and 6 illustrate an alternative embodiment of the compression conveyor of the present invention. The paddle compression conveyor 71 has a pair of paddle shafts 73 rotatably driven by a chain 75 linked to the shear drive shaft 45. The counter-rotation of the paddle shafts is indicated by Arrows E and F. Flanged bearings 77 are fixed to a frame, not shown, to ensure that the paddle assemblies remain in place.

Flat paddles 79 are welded into notched wheels 81 which are carried on bearings 83. Each paddle 79 has an outer periphery having two sloped edges 85 and a flattened center 87 to define a U-like opening for acceptance of a scrap tire 11.

In operation, an upright tire 11 is rolled along a platform 89 into the paddle compression conveyor 71. The sloped edges 85 of the paddles 79 will grasp the tire to advance the tire into the first rotary shear 13. The paddles 79 provide a compression force to the thread area of the tire, compressing the tire to approximately six inches before the tire reaches the first rotary shear. Movement into the first rotary shear is a linear movement.

Figure 7:
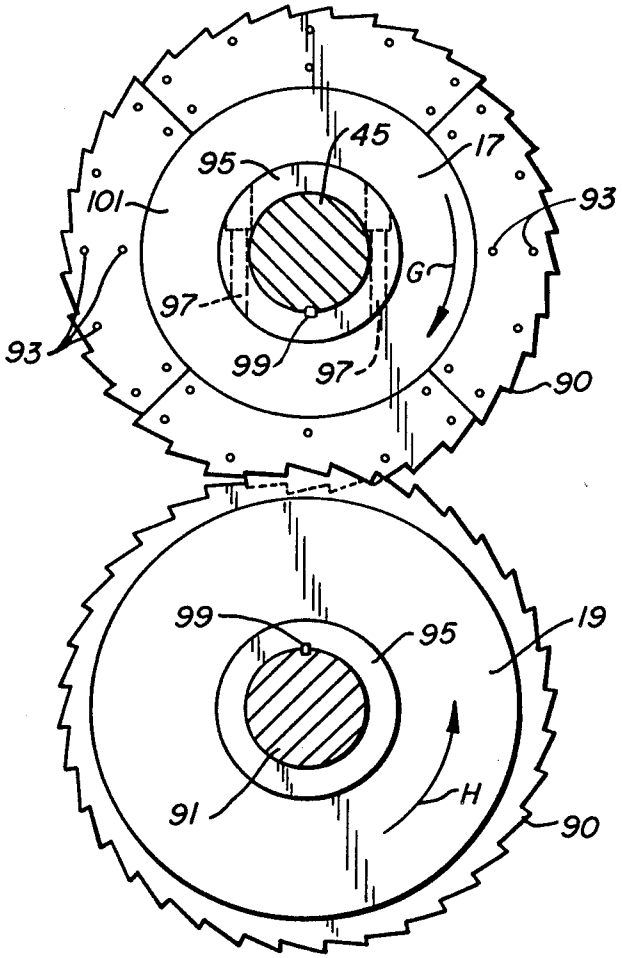
FIG. 7 is a side view taken along lines 7—7 of FIG. 3.
Figure 8B:
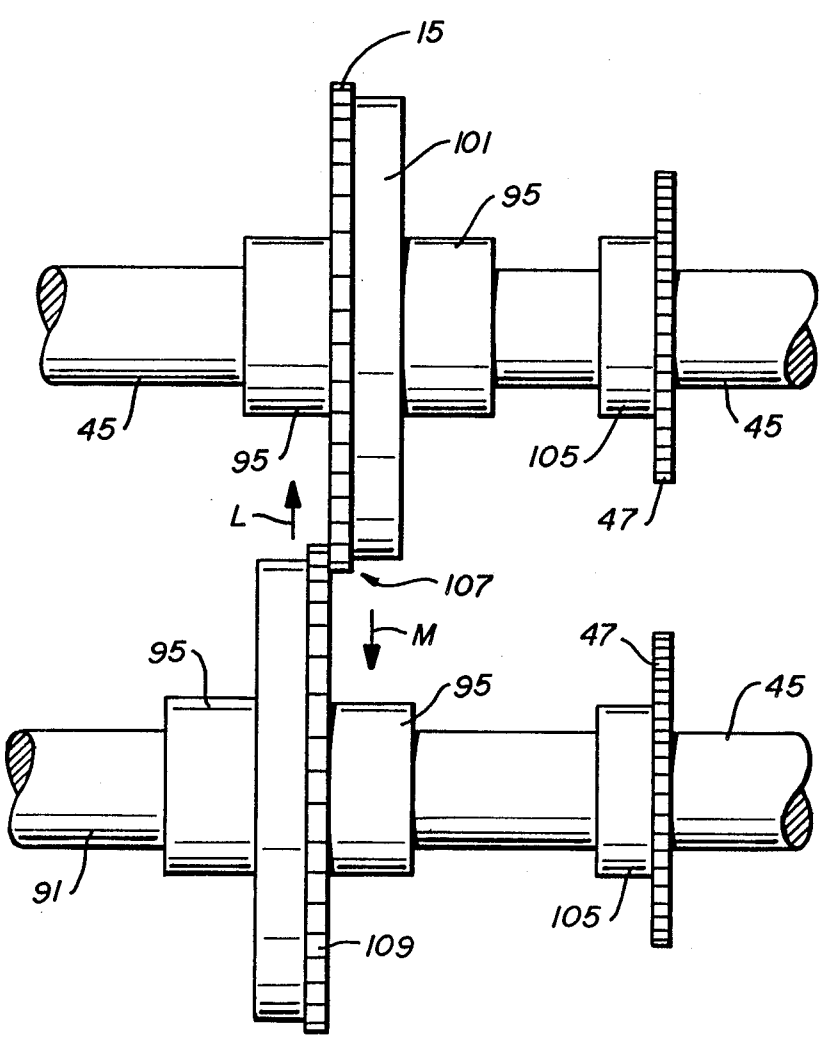
FIG. 8B is a rear view of an alternative embodiment of the apparatus of FIG. 8A.
Figure 8A:
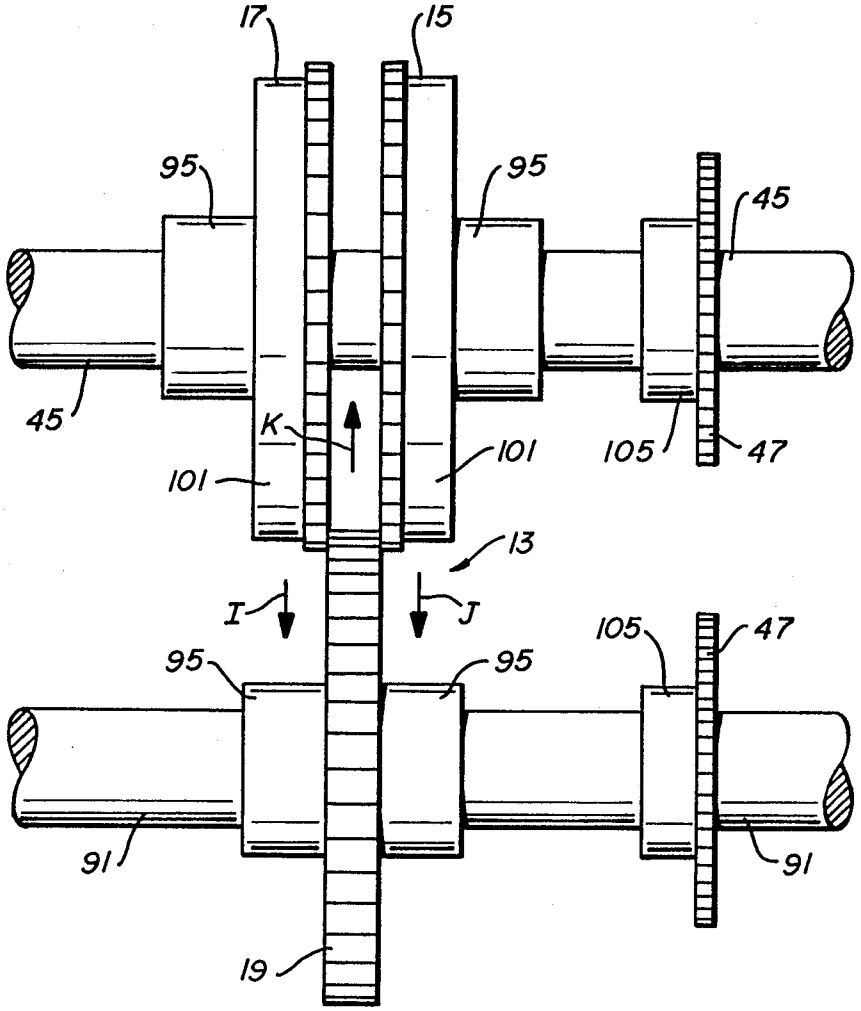
FIG. 8A is a rear view taken along lines 8A—8A of FIG. 3.

Referring to FIGS. 7 and 8A, shears 15 and 17 are driven in the opposite direction of the lower shear 19, as indicated by Arrows G and H. The shears 15, 17 and 19 are sawtoothed in profile, like huge saw blades, having hardened steel members 90 as cutters. The shears have an annular formation and are supported upon a pair of parallelly disposed shafts 45 and 91 with the counter-rotating shears in a contacting relation. The sawtooth periphery of the shear 17 may be sectionally changed by removal of bolts 93. The shears are held in place by bearings 95 which are secured by bolts 97 and drive keys 99.

The upper shears 15 and 17 have outer flanges 101. Referring briefly to FIG. 3, the upper shears 15 and 17 are prevented from moving away from the middle shear 19, not shown, by bolts 103.

Optimally, the shear 19 is one to two inches in width and is in contacting relation with the shears 15 and 17. To function properly the spacing between the shear 19 and shears 15 and 17 should not exceed 0.003 inches.

Shafts 45 and 91 may be rotated from between zero and twenty revolutions per minute. It has been found that rotation at 9.5 rpm is best for blade life preservation. Since sprockets 105, which drive chain 47, are keyed to the shafts 45 and 91, the compression conveyor 39 will be moved at the same speed as the shears.

The compression conveyor feeds a collapsed tire into the first rotary shear 13. The rotary shear 13 makes a pair of cuts along the flattened circumferential periphery of the tire. The still intact side walls are displaced in the direction of Arrows I and J while the crown portion is displaced in the direction of Arrow K.

FIG. 8B illustrates an alternate embodiment of the first rotary shear. The first rotary shear 107 of FIG. 8B includes only two shears 15 and 109. The shear 109 has the same construction as shear 17 of FIG. 8A, but because shaft 45 now carries one shear 15 the rotary shear 107 will make one lengthwise cut, rather than two. The side wall halves of the segmented tire will travel in the direction of Arrows L and M.

Figure 9:
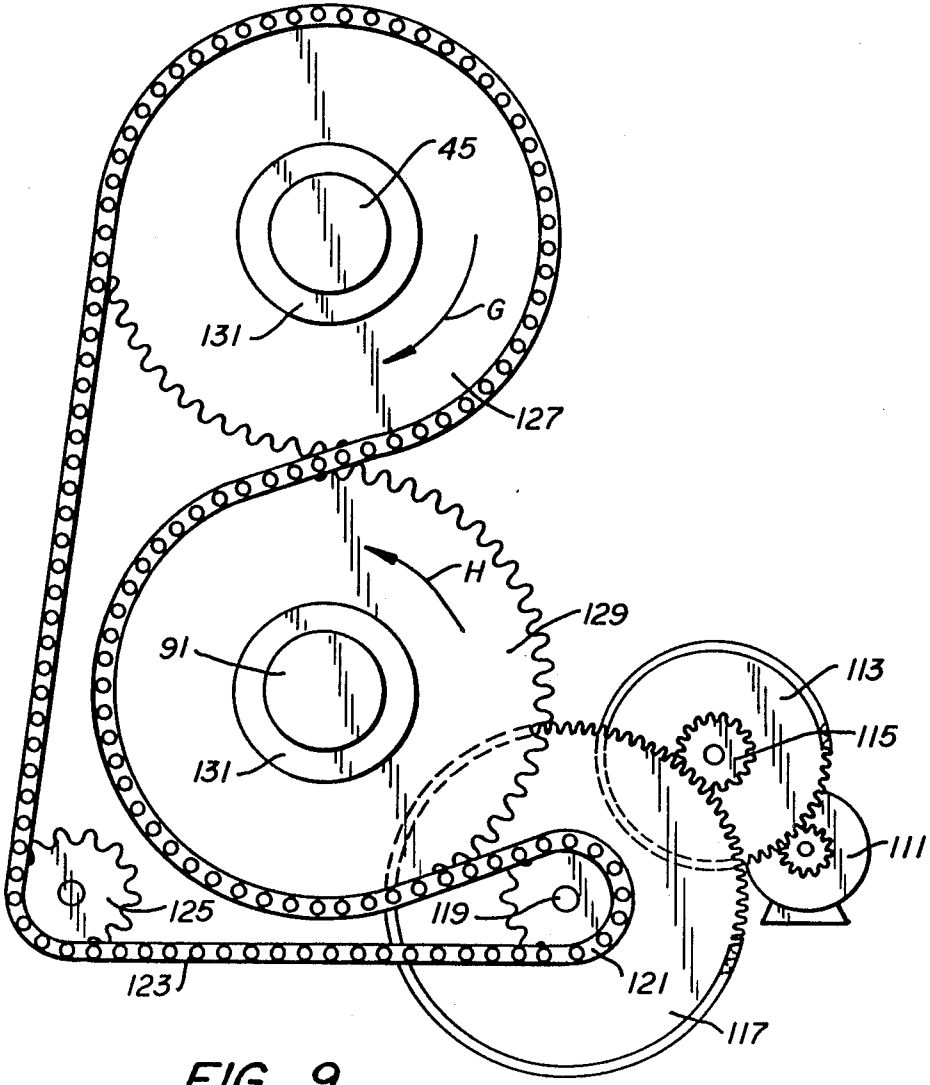
FIG. 9 is a side view taken along line 9—9 of FIG. 3.

The means for driving the shear shafts 45 and 91 is seen in FIG. 9. An electric, gasoline or diesel motor 111 is connected to a ten-to-one gear box 113. The gear box 113 has a sprocket 115 that intermeshes with the teeth of a large sprocket 117 that is keyed to the shaft 119 of a drive sprocket 121. The drive sprocket 121 powers a drive chain 123.

The drive chain 123 is laced about an adjustment idler gear 125 and drive gears 127 and 129 that are keyed to shear shafts 45 and 91. Thus, synchronized counter-rotation of the shafts 45 and 91 is ensured. Power transmission from one shaft to another is not necessary since one chain 123 powers both shafts 45 and 91. One motor 111 of less than 30 hp is sufficient. Adjustment idler gear 125 may be repositioned for proper tension of the drive chain 123. The drive gears 127 and 129 are keyed to the respective shafts 45 and 91 through bearings 131.

Referring again to FIGS. 2 and 3, after a scrap tire has been cut by the first rotary shear 13, the tire segments fall by gravity from the first rotary shear into a hopper 132 where the segments are centered by auger flights 133 and 135. The back sheet 137 of the hopper extends into the first rotary shear 13 to plow out segments from between the adjacent shears 15 and 17.

The spirals 139 of the rotating auger flights 133 and 135 impel the tire segments into an endless loop chain 141 having a plurality of hooks 143. The endless loop chain is trained about sprockets 145, 147 and 149. Sprocket 149 is keyed to a shaft 151 and auger flights 133 and 135 are coaxially mounted to the shaft 151 so that movement of the chain, as shown by Arrows N, will drive the auger flights.

The inner circumference of a tire segment is grasped by a chain hook 143. The hooks 143 extrude through a slot 153 in a drag pan 155. The drag pan 155 provides friction to center a tire segment so that tire segments terminate equidistant between a second rotary shear 27 and a third rotary shear 29. In this manner, each tire segment is cut into four arcuate sections. The arcuate sections of the tire then slide down a chute 157 to a radial stacking conveyor, not shown.

Figure 10:
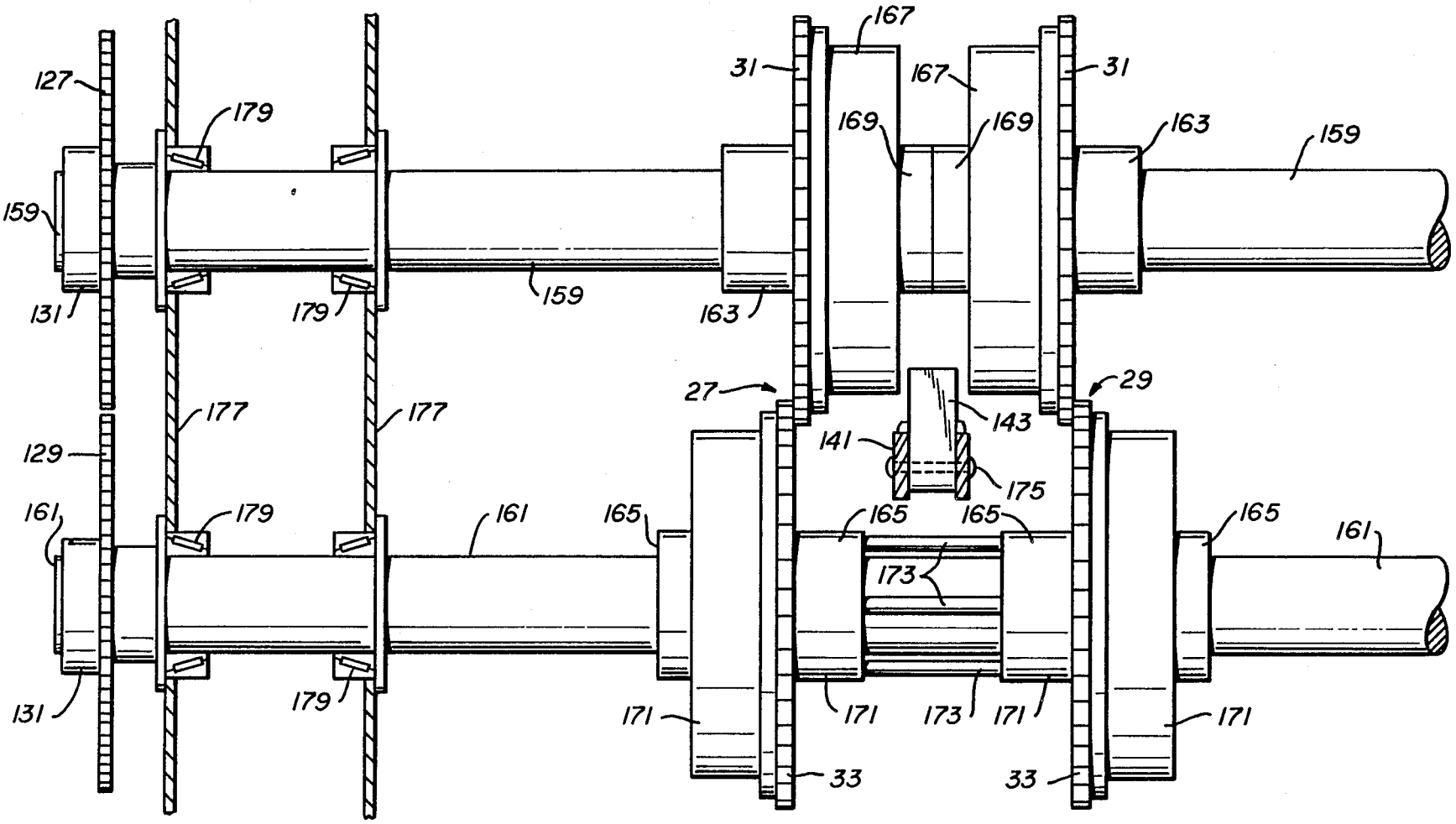
FIG. 10 is a front view taken along lines 10—10 of FIG. 3.

This quartering process may be seen in FIG. 10. The second rotary shear 27 and the third rotary shear 29 each have an upper shear 31 and a lower shear 33. Each rotary shear 27 and 29 works in the same manner as the offset rotary shear shown in FIG. 8B. That is, the upper shear 31 is in contacting relation to the lower shear 33. The shears 31 and 33 have sawtooth blades and are keyed to parallel shafts 159 and 161 through bearings 163 and 165. The upper shears 31 have a flanged portion 167 and are spaced apart by spacer hubs 169. Likewise, the lower shears 33 have a flanged portion 171. Studs 173 passing through bearings 165 may be tightened, thereby providing a means of maintaining a zero clearance between shears 31 and 33 after the shears have been worn or sharpened. Clearance between shears 31 and 33 should not exceed 0.003 inches.

An annular tire segment is pulled into the second rotary shear 27 and third rotary shear 29 by a chain hook 143. The chain hook is secured to the chain 141 by a bolt 175.

The manner of driving the shafts 159 and 161 is identical to that of driving the shafts of the first rotary shear 13, as described with reference to FIG. 9. A drive chain is trained about drive gears 127 and 129 to rotate the drive gears in a counter-rotational fashion at approximately 10 rpm. The drive gears 127 and 129 are keyed to the shafts through bearings 131.

FIGS. 3 and 10 show that the shear shafts 159 and 161 are cantilevered from a station 177. The shafts 159 and 161 are each secured to the station 177 by a pair of bearings 179. Likewise, the shear shafts of the first rotary shear 13 are cantilevered from a station 181.

The three rotary shears 13, 27 and 29 will combine to shear a tire into at least eight arcuate pieces which translates into a storage and volume reduction of better than 50 percent. These pieces are now suitable for fine reduction in other equipment.

I claim:

1. An apparatus for shearing tires of the type having tread about a circumferential periphery, comprising, collapsing means for exerting compression force on a circumferential periphery of a tire, thereby bringing opposed tread regions of the tire into proximity, advancement means in communication with said collapsing means for providing relative motion of said collapsed tire and a shear station, said relative motion being a linear motion, and a shear station having a plurality of rotary shears disposed to receive said linearly advancing collapsed tire and aligned relative to the circumferential periphery of the collapsed tire to shear across the circumferential periphery, thereby forming at least two annular segments.

2. The apparatus of claim 1 wherein said shear station has first and second rotary shears, said first shear supported by a first shaft, said second shear supported by a second shaft parallel to said first shaft, said first shaft spaced apart from said second shear by a distance less than a radius of said first shear.

3. The apparatus of claim 2 wherein said advancement means causes linear motion of the collapsed tire is in a direction substantially perpendicular to the orientation of said circular shears.

4. The apparatus of claim 2 wherein said shear station includes a third rotary shear coaxially mounted to said first shaft, said shear station forming three annular segments when a collapsed tire is received into said shear station.

5. The apparatus of claim 2 wherein said first and second rotary shears are laterally spaced apart by a distance not exceeding 0.003 inches.

6. The apparatus of claim 1 wherein said collapsing means is a compression conveyer having a compression assembly in a gripping assembly, said compression assembly having a plurality of parallel compression roller shafts aligned in a V-shaped configuration, each compression roller shaft having a plurality of coaxial compression rollers, said gripper assembly having a plurality of parallel gripper roller shafts disposed perpendicular to said compression roller shafts, each gripper roller shaft having a plurality of coaxial gripper rollers, said gripper roller shafts aligned in a pair of rows on opposed sides of said V-shaped compression assembly to form a funnel-like conveyer to said shearing station, said gripper assembly having a means for biasing said pair of rows in the direction of each other.

7. The apparatus of claim 6 wherein said linear advancement means includes a drive motor in communication with said compression conveyer to rotate at least some of said compression and gripper roller shafts.

8. The apparatus of claim 1 wherein said collapsing means is a compression conveyer having a first and second paddle assembly, each paddle assembly having a plurality of paddles and a rotatably mounted paddle shaft, said paddles of each paddle assembly having a first side coaxially fixed to said paddle shaft, each paddle having a second side opposite said first side, said second side having downwardly sloped edges and a flat bottom to form a U-like configuration for accepting the circumferential periphery of a tire, said first and second paddle assemblies parallelly spaced apart and disposed to center a tire for acceptance by said shearing station.

9. An apparatus for shearing tires of the type having a crown portion, opposed side walls and a center defining a tire axis, said apparatus comprising, a transport having a collapsing means for exerting a force on a crown portion of a tire perpendicular to the tire axis so as to flatten said tire, said transport further having means for linearly advancing said flattened tire, and a rotary shear station stationed to accept said linearly advancing flattened tire from said transport, said rotary shear station having two circular shears including a first shear and a second shear separately supported upon a pair of parallelly disposed counter rotating shafts spaced apart by a distance less than the sum of the radii of said first and second shears so that the radially outward portions of said shears are in side-by-side relation, said first shear and said second shear disposed to linearly cut across said crown portion of the flattened tire to form at least two annular tire segments.

10. The apparatus of claim 9 wherein said rotary shear station has a third circular shear, said first shear and said third shear coaxially mounted to a first shaft of said pair of shafts and spaced apart by said second shear, said rotary shear station disposed to cut across said crown portion of the flattened tire to form three annular tire segments.

11. The apparatus of claim 10 wherein said first and second shears have first sides laterally spaced apart from each other by a distance not exceeding 0.003 inches, said second shear having a second side and said third shear having a first side laterally spaced apart from said second side of the second shear by a distance not exceeding to 0.003 inches.

12. The apparatus of claim 9 wherein said first shear is supported on a first shaft of said pair of shafts and said second shear is supported on a second shaft of said pair of shafts, said first shaft having a coaxially mounted first drive gear, said second shaft having a coaxially mounted second drive gear, a drive means having a drive chain meshing with said first and second drive gears to counter rotationally rotate said first and second shafts.

13. The apparatus of claim 9 wherein said transport includes a plurality of rotatable compression shafts and a plurality of rotatable gripping shafts, said compression shafts each supporting a plurality of compression rollers, said gripping shafts each supporting a plurality of gripping rollers, said compression shafts disposed perpendicular to said gripping shafts, said compression shafts and said gripping shafts combining to form a funnel-like configuration.

14. A method of shearing automotive tires of the type having tread about a circumferential periphery and a center defining a tire axis, comprising, compressing a tire by circumferential pressure thereby bringing opposed tread regions into proximity to elongate the tire, advancing the compressed tire in a substantially straight-line fashion, and shearing the compressed tire during straight-line advancement, said shearing being along the length of said compressed tire to form at least two annular tire sections.

15. The method of claim 14 further defined by shearing the compressed tire linearly along its circumferential periphery with two slightly spaced parallel cuts, forming three annular sections.

* * * * *